US009780468B2

(12) United States Patent
Yokoyama

(10) Patent No.: US 9,780,468 B2
(45) Date of Patent: Oct. 3, 2017

(54) CONNECTOR COMPRISING SHELL AND TWO ADDITIONAL MEMBERS

(71) Applicant: Japan Aviation Electronics Industry, Limited, Tokyo (JP)

(72) Inventor: Yohei Yokoyama, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/249,527

(22) Filed: Aug. 29, 2016

(65) Prior Publication Data

US 2017/0093062 A1 Mar. 30, 2017

(30) Foreign Application Priority Data

Sep. 29, 2015 (JP) ..... 2015-191758

(51) Int. Cl.

| | |
|---|---|
| ***H05K 1/00*** | (2006.01) |
| ***H01R 12/70*** | (2011.01) |
| ***H01R 13/504*** | (2006.01) |
| ***H01R 13/6595*** | (2011.01) |
| *H01R 13/6581* | (2011.01) |
| *H01R 12/71* | (2011.01) |

(52) U.S. Cl.

CPC ..... *H01R 12/7047* (2013.01); *H01R 13/504* (2013.01); *H01R 13/5045* (2013.01); *H01R 13/6595* (2013.01); *H01R 12/714* (2013.01); *H01R 13/6581* (2013.01)

(58) Field of Classification Search

CPC ..... H01R 12/7047
USPC ..... 439/78
See application file for complete search history.

(56) References Cited

U.S. PATENT DOCUMENTS 4,943,244 A * 7/1990 Teck ..... H01R 12/716 439/567
5,352,135 A * 10/1994 Lenoir ..... H01R 13/506 439/607.4
5,957,705 A * 9/1999 David ..... H01R 12/716 439/79

(Continued)

FOREIGN PATENT DOCUMENTS

CN 104733882 A 6/2015
CN 204391417 * 6/2015

(Continued)

*Primary Examiner* — Tulsidas C Patel
*Assistant Examiner* — Peter G Leigh
(74) *Attorney, Agent, or Firm* — Collard & Roe, P.C.

(57) ABSTRACT

A connector is mateable with an object along a front-rear direction. The connector comprises a housing, a shell and an additional member. The housing has a base portion and a body portion. The body portion extends forward from the base portion along the front-rear direction. The shell has a cylindrical portion which covers the body portion of the housing in a plane perpendicular to the front-rear direction. The cylindrical portion has a connected portion. The additional member is press-fit in the base portion of the housing and has a main portion and a connection portion. The connection portion of the additional member extends from the main portion along the front-rear direction and is welded to the connected portion of the shell. The body portion of the housing and the connection portion sandwich the connected portion in a perpendicular direction perpendicular to the front-rear direction.

11 Claims, 13 Drawing Sheets

(56) References Cited

U.S. PATENT DOCUMENTS 6,050,852 A * 4/2000 Wu ..... H01R 13/629 439/607.02
7,658,624 B2 * 2/2010 Fang ..... H01R 12/714 439/79
8,083,549 B1 * 12/2011 Chiang ..... H01R 13/6581 439/607.55
8,602,822 B2 * 12/2013 Siahaan ..... H01R 13/6581 29/857
8,784,136 B2 * 7/2014 Siahaan ..... H01R 13/6581 439/607.41
9,011,179 B2 * 4/2015 Siahaan ..... H01R 13/504 439/606
9,231,356 B1 1/2016 Ju et al.
9,564,715 B1 * 2/2017 Lin ..... H01R 13/6581
2002/0004337 A1 * 1/2002 Chiang ..... H01R 12/7023 439/607.01
2009/0209132 A1 * 8/2009 Sato ..... H01R 12/725 439/607.41
2010/0232118 A1 * 9/2010 Tochi ..... G06K 7/0047 361/737
2014/0065866 A1 * 3/2014 Xie ..... H01R 12/724 439/272
2014/0357124 A1 * 12/2014 Zhao ..... H01R 13/405 439/607.55
2015/0171561 A1 * 6/2015 Little ..... H01R 24/60 439/607.34
2015/0207280 A1 * 7/2015 Little ..... H01R 24/60 439/607.34
2015/0229077 A1 * 8/2015 Little ..... H01R 12/724 439/78
2015/0244110 A1 * 8/2015 Ju ..... H01R 13/6585 439/607.01
2015/0270646 A1 * 9/2015 Kao ..... H01R 13/6581 439/76.1

FOREIGN PATENT DOCUMENTS

CN 204391417 U 6/2015
JP H10-172685 A 6/1998
TW M496862 U 3/2015

* cited by examiner

CONNECTOR COMPRISING SHELL AND TWO ADDITIONAL MEMBERS

CROSS REFERENCE TO RELATED APPLICATIONS

This application is based on and claims priority under 35 U.S.C. §119 to Japanese Patent Application No. JP2015-191758 filed Sep. 29, 2015, the contents of which are incorporated herein in their entirety by reference.

BACKGROUND OF THE INVENTION

The present invention relates to a connector which comprises a shell and an additional member welded to the shell.

For example, this type of connector is disclosed in CN 204391417U (Patent Document 1), the content of which is incorporated herein by reference.

Referring to FIG. 24, Patent Document 1 discloses a connector 900 which comprises a housing 910 made of insulator and a shielding member 930 made of metal. The shielding member 930 covers a front part, or the positive X-side part, of the housing 910 in a front-rear direction (X-direction). The shielding member 930 is attached to the housing 910 along the X-direction and is positioned forward, or toward the positive X-side, of the housing 910. The shielding member 930 is formed of two members, namely, a first case (shell) 940 and a second case (additional member) 950. The first case 940 has a fit portion (cylindrical portion) 942 which extends along the X-direction. The cylindrical portion 942 partially covers the housing 910. The second case 950 has a box-like shape.

Referring to FIG. 25, the first case 940 has two connection portions 944. The second case 950 has a cut-out hole 952 and two connected portions 954. When the shielding member 930 is formed, the cylindrical portion 942 is inserted into the cut-out hole 952 from behind to project forward. The insertion brings the connection portions 944 into abutment with rear surfaces, or the negative X-side surfaces, of the connected portions 954, respectively. Subsequently, the connection portions 944 are welded to the rear surfaces of the connected portions 954, respectively. Although each of the two members (i.e., the first case 940 and the second case 950) has a relatively simple shape, they are welded to each other, so that the shielding member 930 can be formed in a complicated shape.

As can be seen from FIGS. 24 and 25, the shielding member 930 is required to be formed prior to the attachment to the housing 910. More specifically, the connection portions 944 of the first case 940 are required to be welded to the connected portions 954 of the second case 950 before the shielding member 930 is attached to the housing 910. Moreover, when each of the connection portions 944 is welded to the corresponding connected portion 954, some maintenance mechanism such as a fixing jig is required to maintain a state where the connection portion 944 and the connected portion 954 are in abutment with each other. In other words, when the shielding member 930 is formed, a maintenance process, in which some maintenance mechanism such as a fixing jig is used, is necessary. This necessity makes a manufacturing cost of the connector 900 increase.

SUMMARY OF THE INVENTION

It is therefore an object of the present invention to provide a connector comprising a shell and an additional member which can be welded to each other with no use of maintenance mechanism.

An aspect of the present invention provides a connector mateable with an object along a front-rear direction. The connector comprises a housing, an internal assembly, a shell and two additional members. The housing has a base portion and a body portion. The body portion extends forward from the base portion along the front-rear direction. The base portion is formed with two press-fit holes which correspond to the additional members, respectively. Each of the press-fit holes extends in a direction intersecting with the front-rear direction. The body portion is formed with an accommodation portion. The internal assembly comprises a holding member and a contact and is partially accommodated in the accommodation portion. The shell has a cylindrical portion. The cylindrical portion covers the body portion of the housing in a plane perpendicular to the front-rear direction and has two connected portions which correspond to the additional members, respectively. Each of the additional members has a main portion, a press-fit portion and a connection portion. The press-fit portion of each of the additional members is connected to the main portion, extends in a direction intersecting with the front-rear direction and is press-fit in the corresponding press-fit hole of the housing. The connection portion of each of the additional members extends from the main portion along the front-rear direction and is welded to the corresponding connected portion of the shell. The body portion of the housing and each of the connection portions sandwich the corresponding connected portion in a perpendicular direction perpendicular to the front-rear direction.

According to the present invention, the cylindrical portion of the shell covers the body portion of the housing in a plane perpendicular to the front-rear direction, and the press-fit portion of each of the additional members is press-fit in the corresponding press-fit hole of the housing. The shell and the additional members are attached to the housing as described above, and this attached state can be maintained with no use of maintenance mechanism such as a fixing jig. Moreover, under the attached state, the body portion of the housing and the connection portion of each of the additional members sandwich the corresponding connected portion of the shell. In other words, each of the connected portions of the shell is positioned on the body portion of the housing, and the connection portion of the corresponding additional member is positioned thereon. Therefore, each of the connected portions of the shell and the connection portion of the corresponding additional member can be welded to each other with no use of maintenance mechanism such as a fixing jig.

An appreciation of the objectives of the present invention and a more complete understanding of its structure may be had by studying the following description of the preferred embodiment and by referring to the accompanying drawings.

Figure 1:
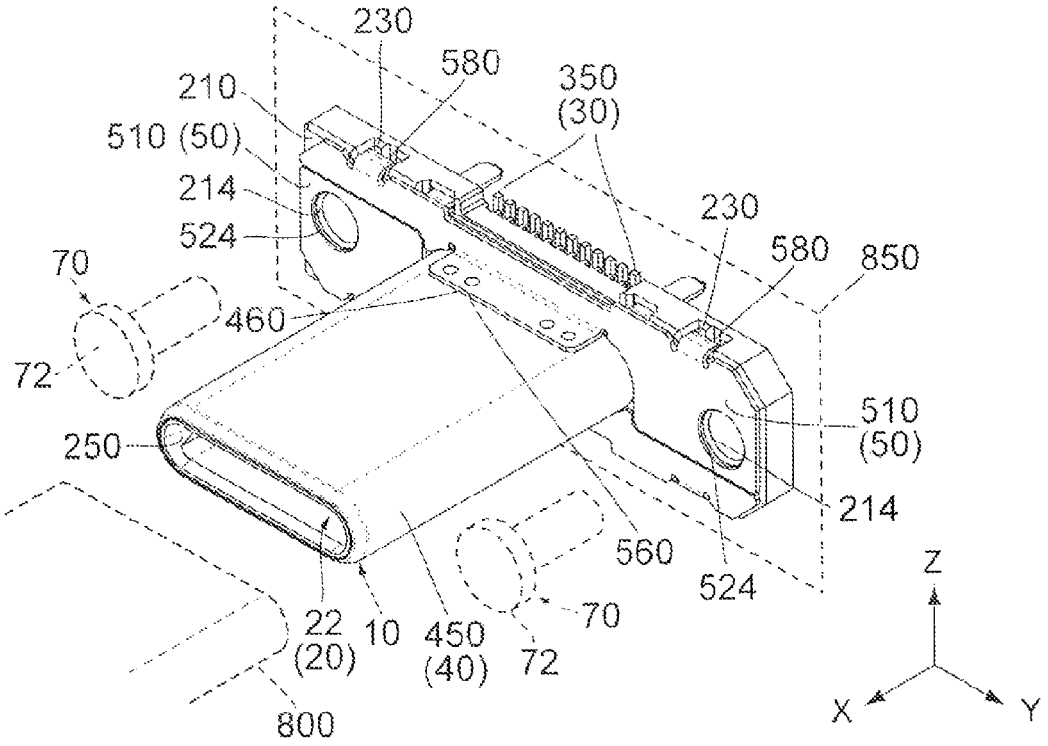
FIG. 1 is a perspective view showing a connector according to an embodiment of the present invention, wherein a part of a mating connector, a part of a circuit board and two screws are illustrated by dashed line.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a connector 10 according to an embodiment of the present invention can be used under a state where the connector 10 is mounted on a circuit board 850, for example, of a device (not shown). In other words, the connector 10 is an on-board connector. The connector 10 is mateable with an object 800 along a front-rear direction (the X-direction). For example, the object 800 is the mating connector 800 installed in a mobile telephone (not shown). However, the present invention is not limited thereto. The present invention is applicable to various connectors mateable with various objects.

Figure 2:
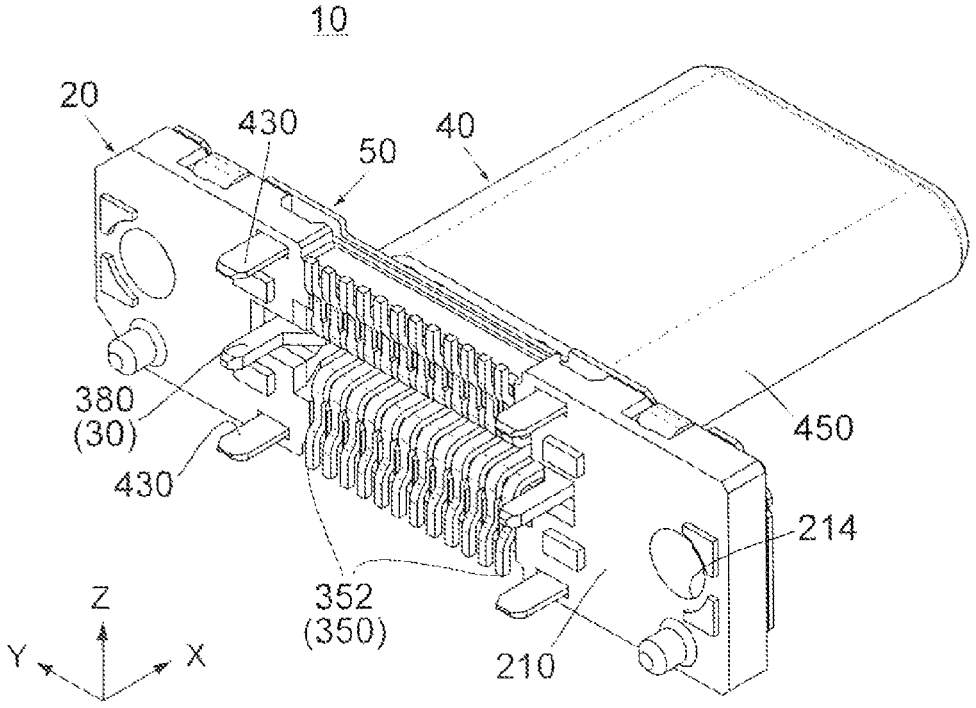
FIG. 2 is another perspective view showing the connector of FIG. 1.
Figure 3:
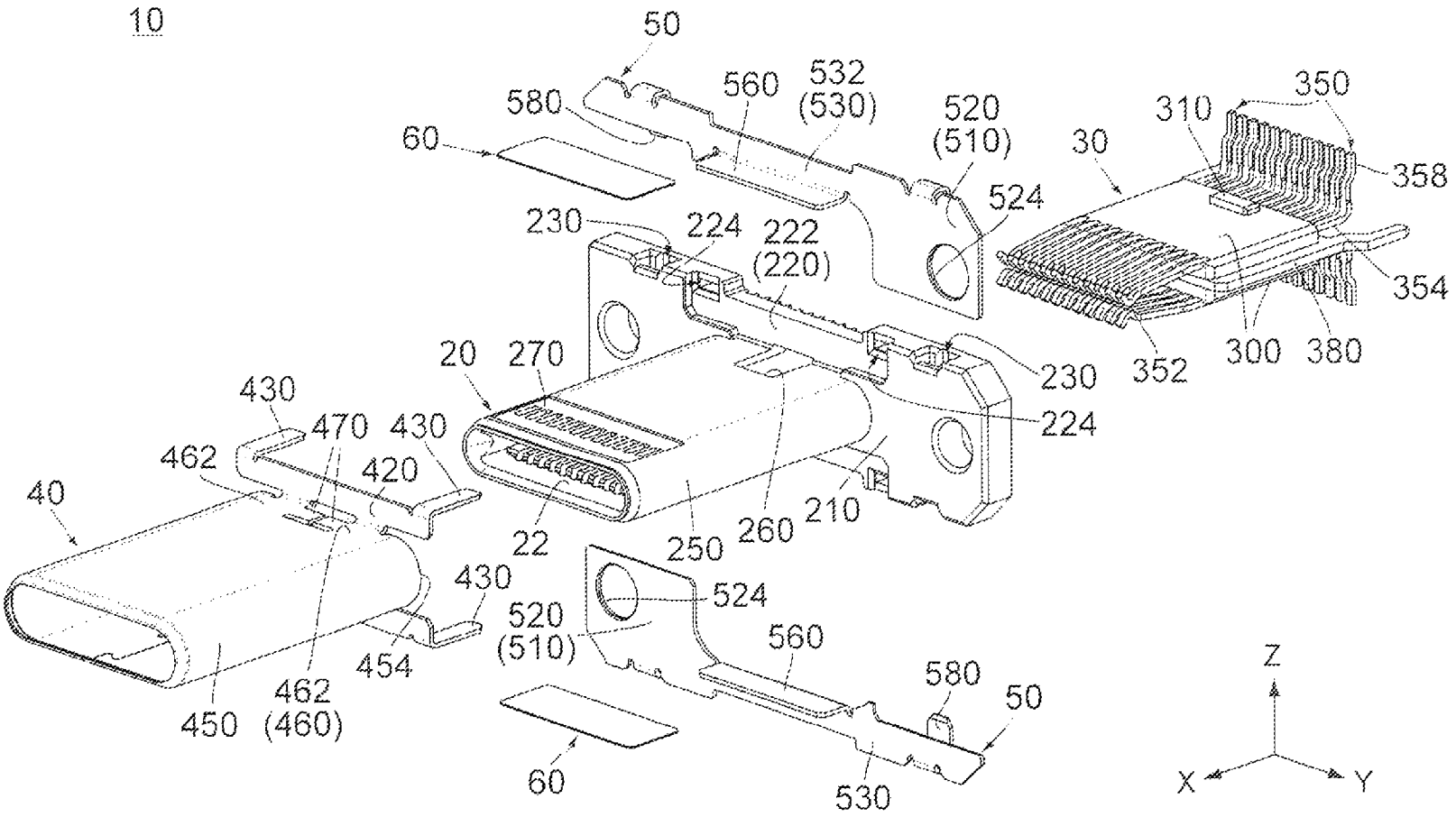
FIG. 3 is an exploded, perspective view showing the connector of FIG. 1.

Referring to FIGS. 1 to 3, the connector 10 comprises a housing 20 made of insulator, an internal assembly 30, a shell 40 made of metal, two additional members 50 each made of metal and two insulating members 60 each made of insulator. The internal assembly 30 comprises two holding members 300 each made of insulator, a plurality of contacts 350 each made of conductor and a ground plate 380 made of conductor.

Figure 10:
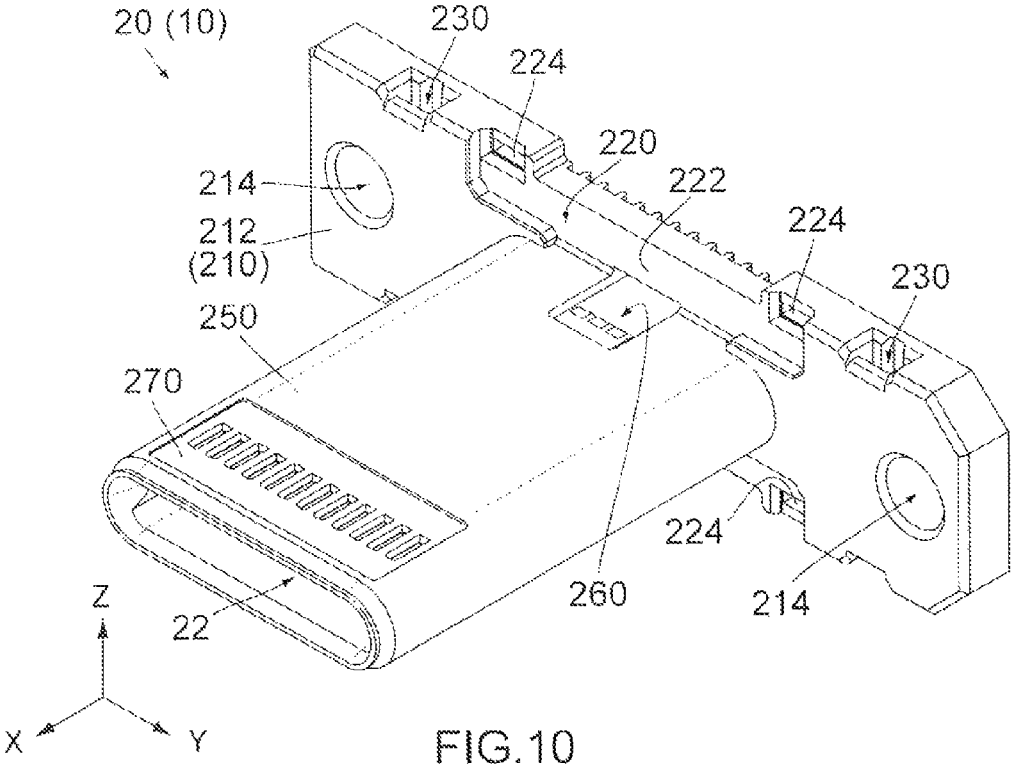
FIG. 10 is a perspective view showing the housing of the connector of FIG. 3.
Figure 11:
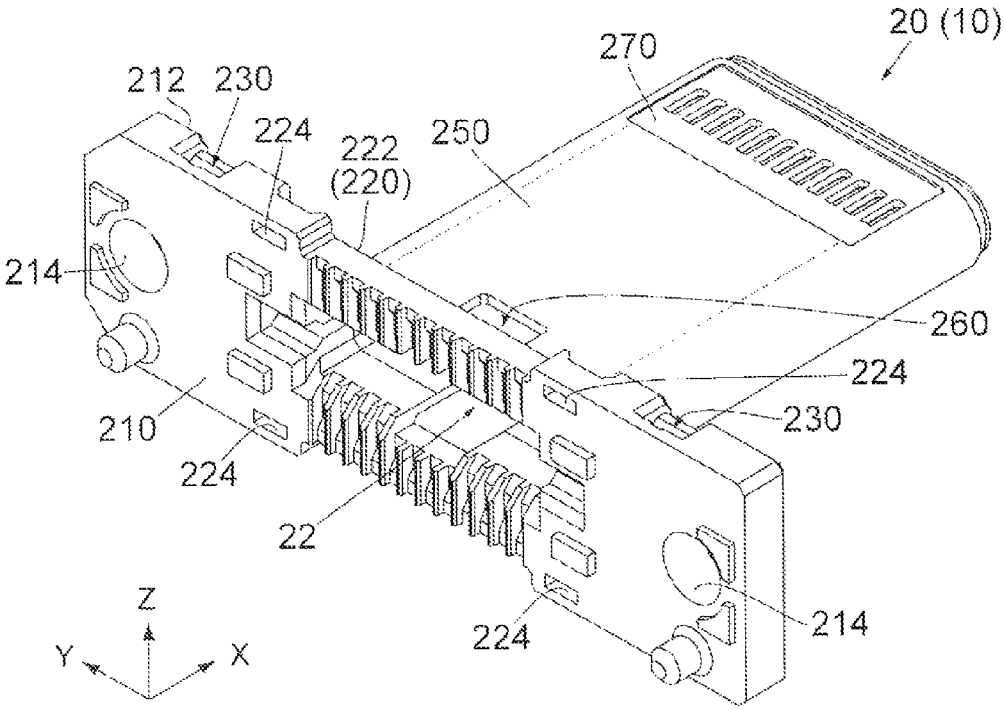
FIG. 11 is another perspective view showing the housing of FIG. 10.

Referring to FIGS. 10 and 11, the housing 20 has a base portion 210 and body portion 250. The base portion 210 has a flat plate-like shape extending in parallel to the YZ-plane. In the YZ-plane, the base portion 210 has a rectangular cross-section which is long in a pitch direction (the Y-direction) and is short in an up-down direction (the Z-direction). The body portion 250 extends forward along the X-direction, or along the positive X-direction, from the base portion 210. More specifically, the body portion 250 has a cylindrical shape which extends along the X-direction. In the YZ-plane, the body portion 250 has a racetrack-like cross-section which is long in the Y-direction and is short in the Z-direction.

The housing 20 has an accommodation portion 22. The accommodation portion 22 is a space which passes through the base portion 210 and the body portion 250 in the X-direction. In other words, the base portion 210 and the body portion 250 are formed with the accommodation portion 22 therewithin. Each of the base portion 210 and the body portion 250 surrounds a part of the accommodation portion 22 in the YZ-plane.

Figure 12:
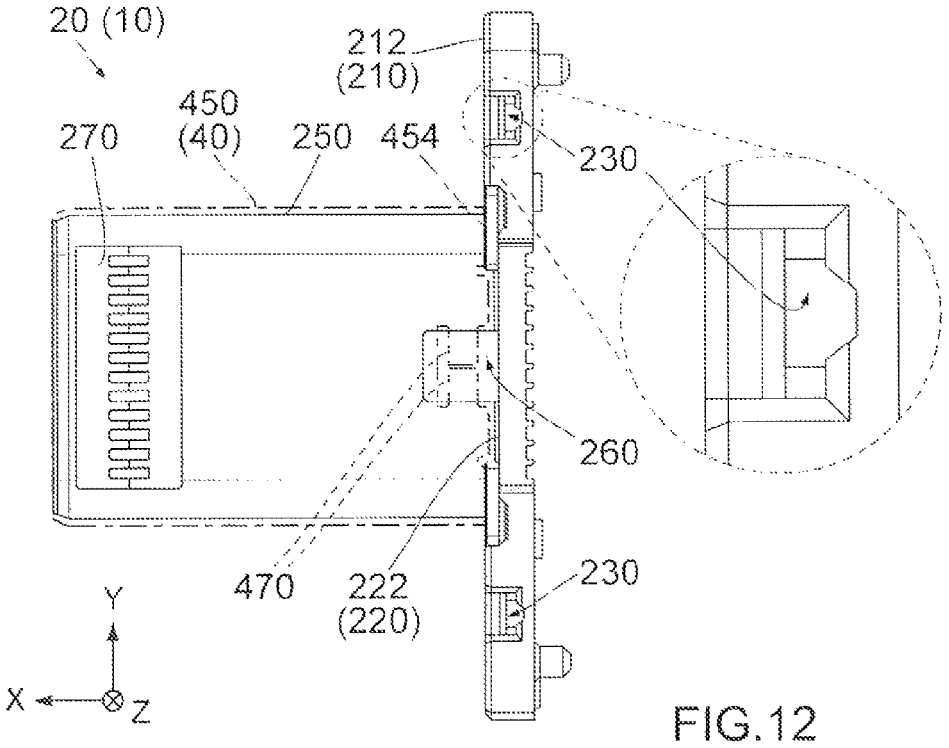
FIG. 12 is a bottom view showing the housing of FIG. 10, wherein a part in the vicinity of the press-fit hole (the part enclosed by dashed line) is enlarged to be illustrated, and an outline of a cylindrical portion of a shell is illustrated by chain dotted line.
Figure 13:
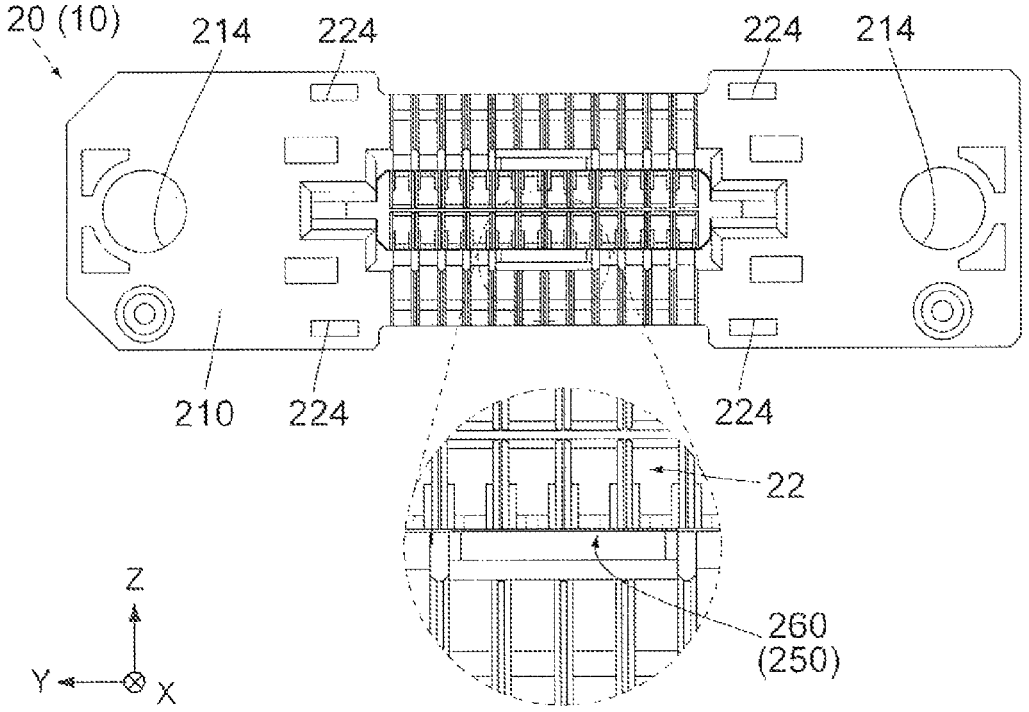
FIG. 13 is a rear view showing the housing of FIG. 10, wherein a part in the vicinity of a receiving portion (the part enclosed by dashed line) is enlarged to be illustrated.
Figure 14:
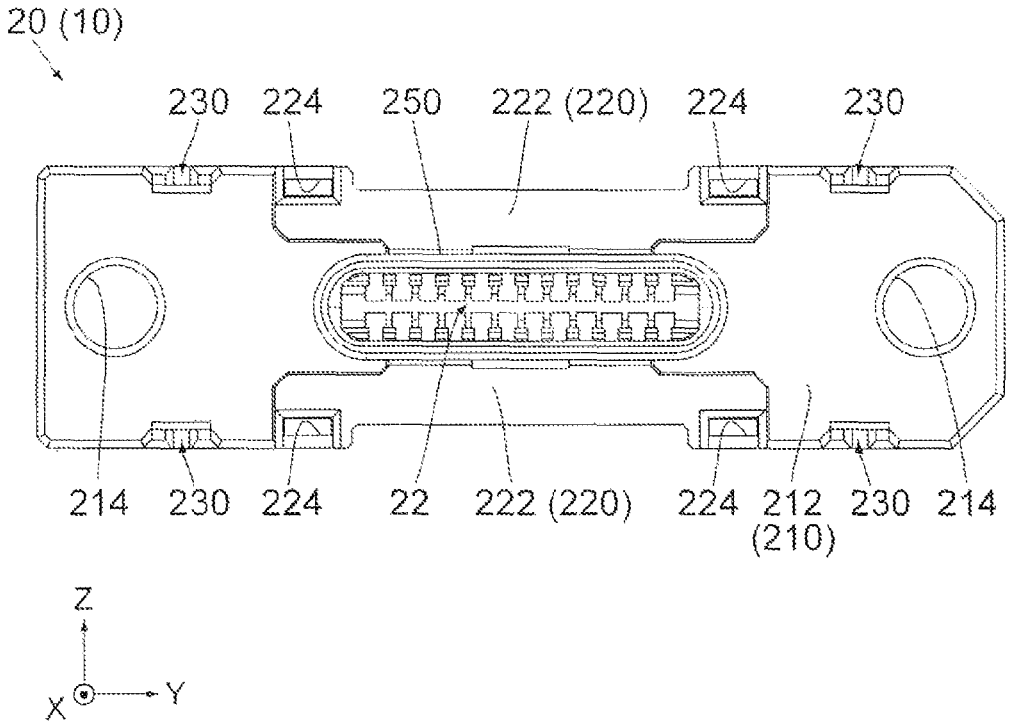
FIG. 14 is a front view showing the housing of FIG. 10.

As shown in FIGS. 10, 12 and 14, the base portion 210 has an abutment surface 212. The abutment surface 212 is a plane extending in parallel to the YZ-plane. The abutment surface 212 is positioned at a front end, or the positive X-side end, of the base portion 210 in the X-direction. Referring to FIGS. 10 to 14, the base portion 210 is formed with two first holes 214, two indented portions 220, four positioning holes 224 and four press-fit holes 230.

Referring to FIGS. 10, 11, 13 and 14, each of the first holes 214 pierces the base portion 210 in the X-direction. The first holes 214 are provided in the vicinities of opposite ends of the base portion 210 in the Y-direction, respectively. The body portion 250 is positioned between the two first holes 214 in the Y-direction.

Referring to FIGS. 10 to 12 and 14, each of the indented portions 220 is indented rearward, or along the negative X-direction, from the abutment surface 212. The indented portions 220 are provided at the middle of the base portion 210 in the Y-direction. In detail, one of the indented portions 220 is positioned above the body portion 250, or beyond the positive Z-side of the body portion 250, and a remaining one of the indented portions 220 is positioned below the body portion 250, or beyond the negative Z-side of the body portion 250. In other words, the body portion 250 is positioned between the two indented portions 220 in the Z-direction. Each of the indented portions 220 has a regulation surface 222. Each of the regulation surfaces 222 is a plane extending in parallel to the YZ-plane and is positioned rearward of the abutment surface 212.

Referring to FIGS. 10, 11, 13 and 14, each of the positioning holes 224 pierces the base portion 210 in the X-direction. In the present embodiment, the positioning holes 224 are provided to the indented portions 220. In detail, two of the positioning holes 224 are positioned at opposite ends of the upper, or the positive Z-side, indented portion 220 in the Y-direction, respectively, and remaining two of the positioning holes 224 are positioned at opposite ends of the lower, or the negative Z-side, indented portion 220 in the Y-direction, respectively. However, the arrangement of the positioning holes 224 is not limited thereto. For example, each of the positioning holes 224 may be formed at a position outside of the indented portions 220.

Referring to FIGS. 10 to 12 and 14, each of the press-fit holes 230 is a space which extends inward of the base portion 210 from an upper end (i.e., the positive Z-side end) or a lower end (i.e., the negative Z-side end) of the base portion 210.

Each of the press-fit holes 230 according to the present embodiment extends in a perpendicular direction perpendicular to the X-direction. Two of the press-fit holes 230 open at the upper end of the base portion 210, and remaining two of the press-fit holes 230 open at the lower end of the base portion 210. The two upper press-fit holes 230 are positioned at the opposite ends of the base portion 210 in the Y-direction, respectively, and extend downward, or in the negative Z-direction. The two lower press-fit holes 230 are positioned at the opposite ends of the base portion 210 in the Y-direction, respectively, and extend upward, or in the positive Z-direction.

Referring to FIGS. 10 to 12, the body portion 250 has an upper surface (i.e., the positive Z-side surface) and a lower surface (i.e., the negative Z-side surface) each of which is formed with a receiving portion 260 and a covered portion 270. Each of the receiving portions 260 is a rectangular hole which pierces the body portion 250 in the Z-direction. Each of the covered portions 270 is an indention which is indented toward the accommodation portion 22 in the Z-direction.

Figure 15:
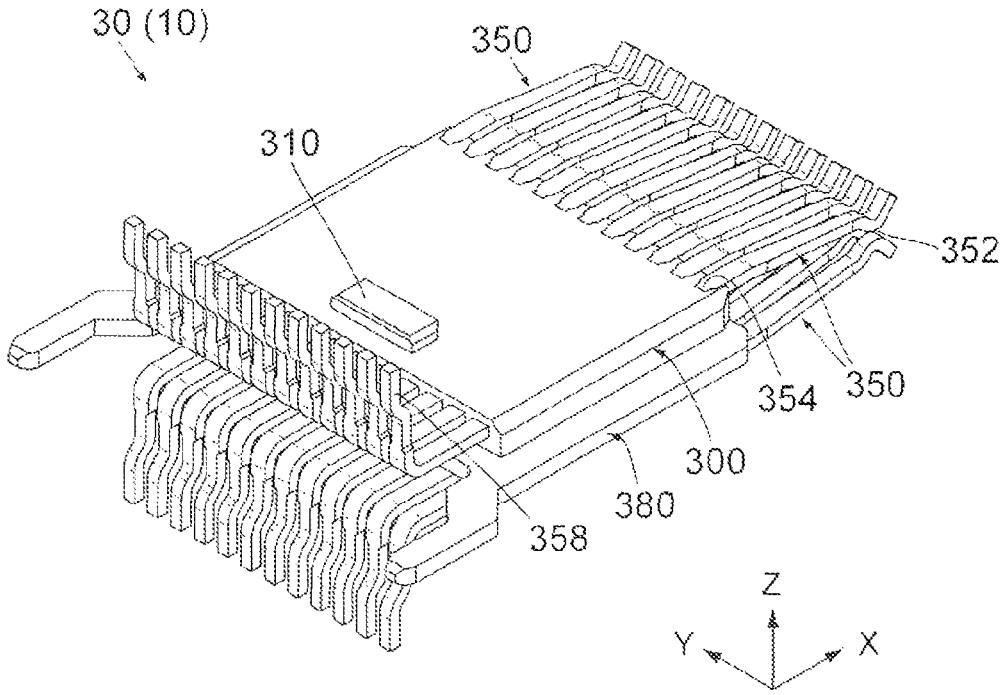
FIG. 15 is a perspective view showing an internal assembly of the connector of FIG. 3.
Figure 16:
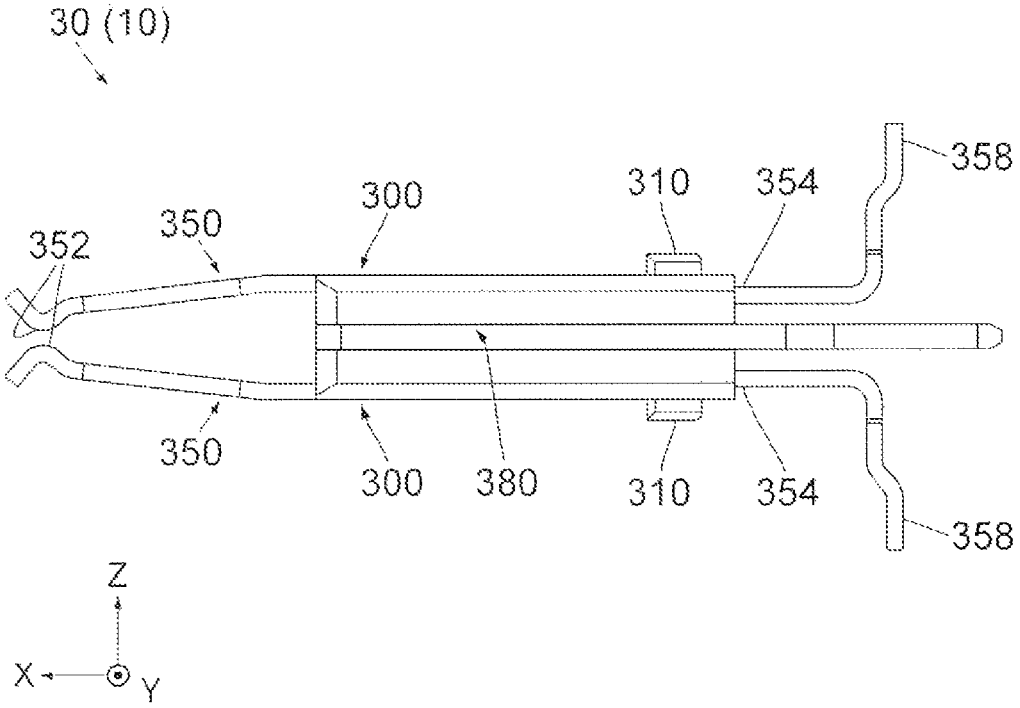
FIG. 16 is a side view showing the internal assembly of FIG. 15.

Referring to FIGS. 3, 15 and 16, the internal assembly 30 has a mirror symmetrical structure with respect to the XY-plane. In detail, the ground plate 380 has a flat plate-like shape perpendicular to the Z-direction. Each of the holding members 300 has a flat plate-like shape perpendicular to the Z-direction except a received portion 310 which projects in the Z-direction. One of the holding members 300 is positioned over the ground plate 380 so that the received portion 310 thereof projects upward, and a remaining one of the holding members 300 is positioned under the ground plate 380 so that the received portion 310 thereof projects downward.

Each of the holding members 300 holds a plurality of the contacts 350 to arrange them in the Y-direction. Each of the contacts 350 has a contact portion 352, a held portion 354 and a fixed portion 358. Each of the held portions 354 extends linearly in the X-direction as a whole. Each of the held portions 354 is partially embedded in one of the holding members 300 via insert-molding to be held by the one of the holding members 300. In each of the contacts 350 held by the upper holding member 300, the contact portion 352 projects downward, and the fixed portion 358 extends upward. In each of the contacts 350 held by the lower holding member 300, the contact portion 352 projects upward, and the fixed portion 358 extends downward.

Figure 17:
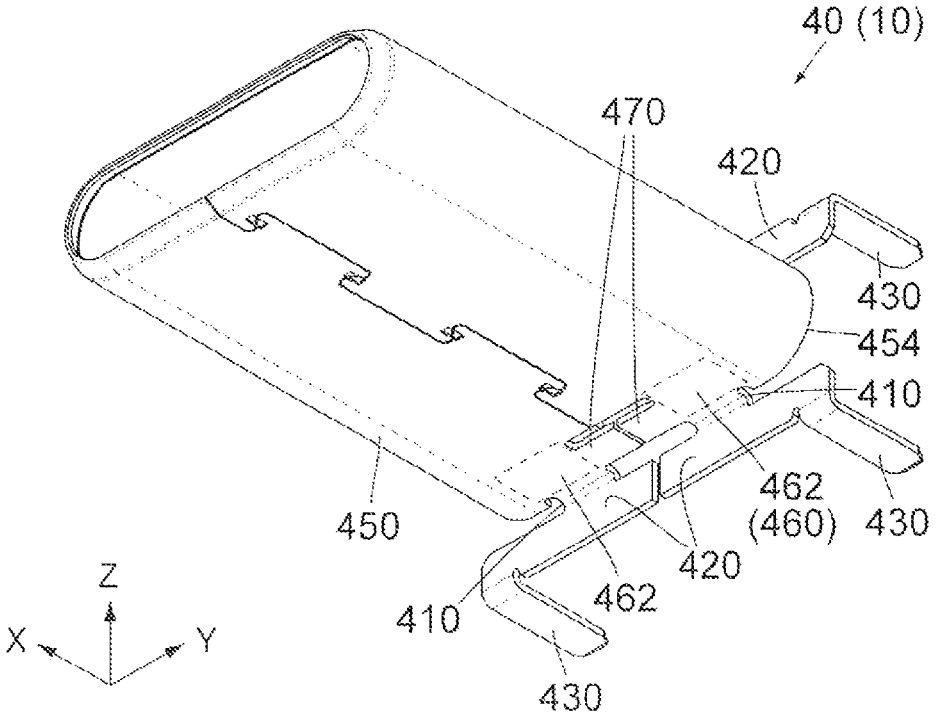
FIG. 17 is a perspective view showing the shell of the connector of FIG. 3, wherein a boundary of each of welded portions is illustrated by dashed line.
Figure 18:
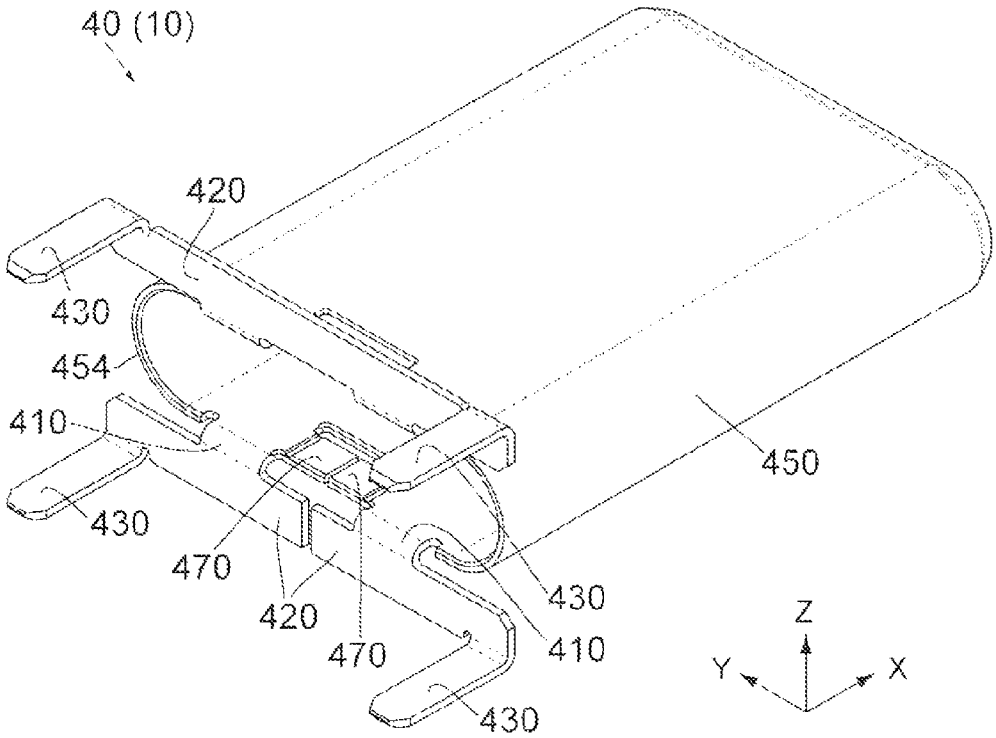
FIG. 18 is another perspective view showing the shell of FIG. 17.

Referring to FIGS. 3, 17 and 18, the shell 40 is a single metal plate that is bent and joined at its ends so that the joined ends (joint) are positioned at a lower side thereof. The shell 40 has a cylindrical portion 450 which is one of main portions thereof. The cylindrical portion 450 has a flat cylindrical shape which extends forward from a rear edge 454 thereof along the X-direction. In the YZ-plane, the cylindrical portion 450 has a racetrack-like cross-section which is long in the Y-direction and is short in the Z-direction. In other words, the cylindrical portion 450 has a shape corresponding to that of the body portion 250 of the housing 20. The cylindrical portion 450 has a lower plate which is formed with the joint of the metal plate.

Referring to FIGS. 3 and 17, the cylindrical portion 450 has two connected portions 460 and four lock portions 470. One of the connected portions 460 and two of the lock portions 470 are provided to an upper plate of the cylindrical portion 450, and a remaining one of the connected portions 460 and remaining two of the lock portions 470 are provided to the lower plate of the cylindrical portion 450.

Each of the connected portions 460 has two welded portions 462. Each of the upper welded portions 462 is a part of the upper plate of the cylindrical portion 450. There is no clearly visible boundary between the upper welded portion 462 and the other part of an upper surface of the cylindrical portion 450. Similarly, each of the lower welded portions 462 is a part of the lower plate of the cylindrical portion 450. There is no clearly visible boundary between the lower welded portion 462 and the other part of a lower surface of the cylindrical portion 450.

Figure 21:
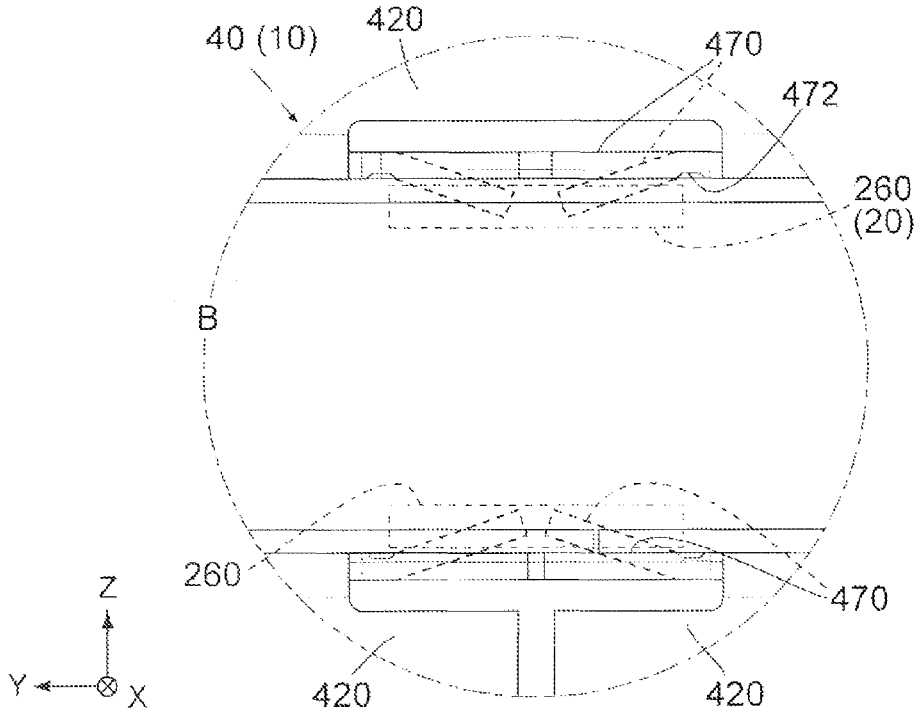
FIG. 21 is a rear view showing a part of the shell (the part enclosed by chain dotted line B) of FIG. 20, wherein an outline of each of the receiving portions of the housing, to which the shell is attached, is illustrated by dashed line, and an outline of each of bent lock portions of the shell is illustrated by dashed line.

The two upper lock portions 470 are positioned between the two upper welded portions 462 in the Y-direction, and the two lower lock portions 470 are positioned between the two lower welded portions 462 in the Y-direction. Each of the upper lock portions 470 is a rectangular metal piece, and the upper lock portions 470 extend inward in the Y-direction from the upper welded portions 462, respectively. Similarly, each of the lower lock portions 470 is a rectangular metal piece, and the lower lock portions 470 extend inward in the Y-direction from the lower welded portions 462, respectively. Referring to FIG. 21 together with FIG. 17, each of the lock portions 470 is provided with a groove 472 which is formed between the lock portion 470 and the corresponding welded portion 462 so that the lock portion 470 can be bent easily.

Referring to FIGS. 17 to 20, the shell 40 has three regulated portions 420 and four fixed portions 430 in addition to the cylindrical portion 450. The regulated portions 420 and the fixed portions 430 are positioned rearward of the rear edge 454 of the cylindrical portion 450.

One of the regulated portions 420 is connected to the upper plate of the cylindrical portion 450 through upper two of coupling portions 410 each of which is bent to have an L-like shape. This upper regulated portion 420 is apart from the upper plate of the cylindrical portion 450. In detail, the upper regulated portion 420 is positioned above and rearward of the upper plate of the cylindrical portion 450. Remaining two of the regulated portions 420 are connected to the lower plate of the cylindrical portion 450 through lower two of the coupling portions 410, respectively. Each of these lower regulated portions 420 is apart from the lower plate of the cylindrical portion 450. In detail, each of the lower regulated portions 420 is positioned below and rearward of the lower plate of the cylindrical portion 450. Each of the regulated portions 420 according to the present embodiment is a metal piece perpendicular to the X-direction. However, each of the regulated portions 420 may be oblique to the X-direction to some extent. In other words, each of the regulated portions 420 may extend in a direction intersecting with the X-direction.

Figure 19:
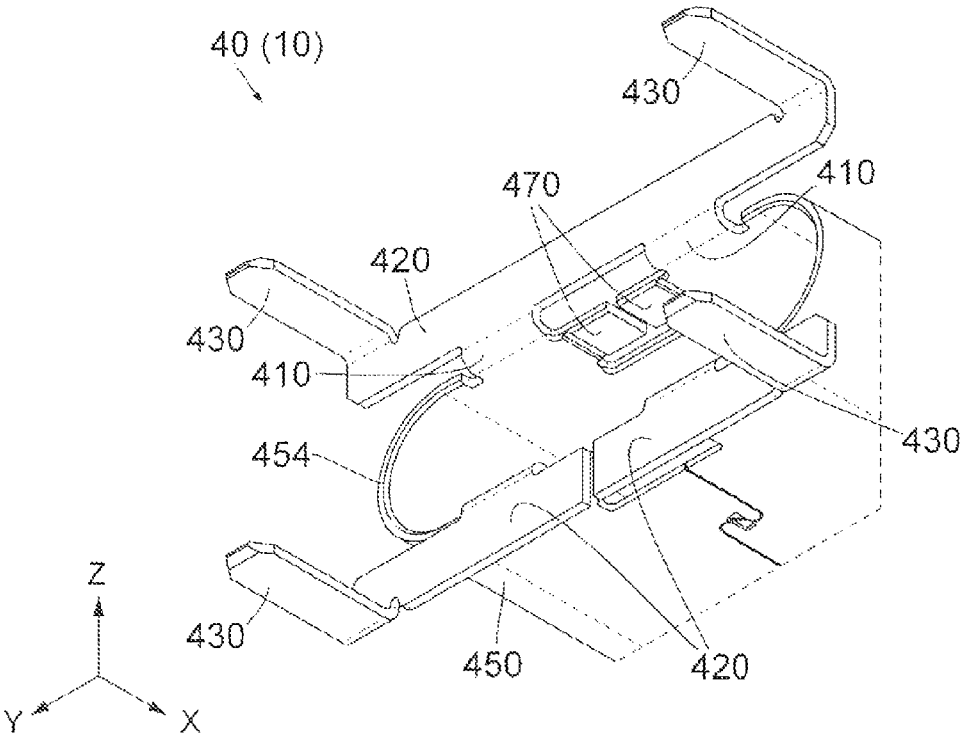
FIG. 19 is a perspective view showing a part of the shell of FIG. 17.
Figure 20:
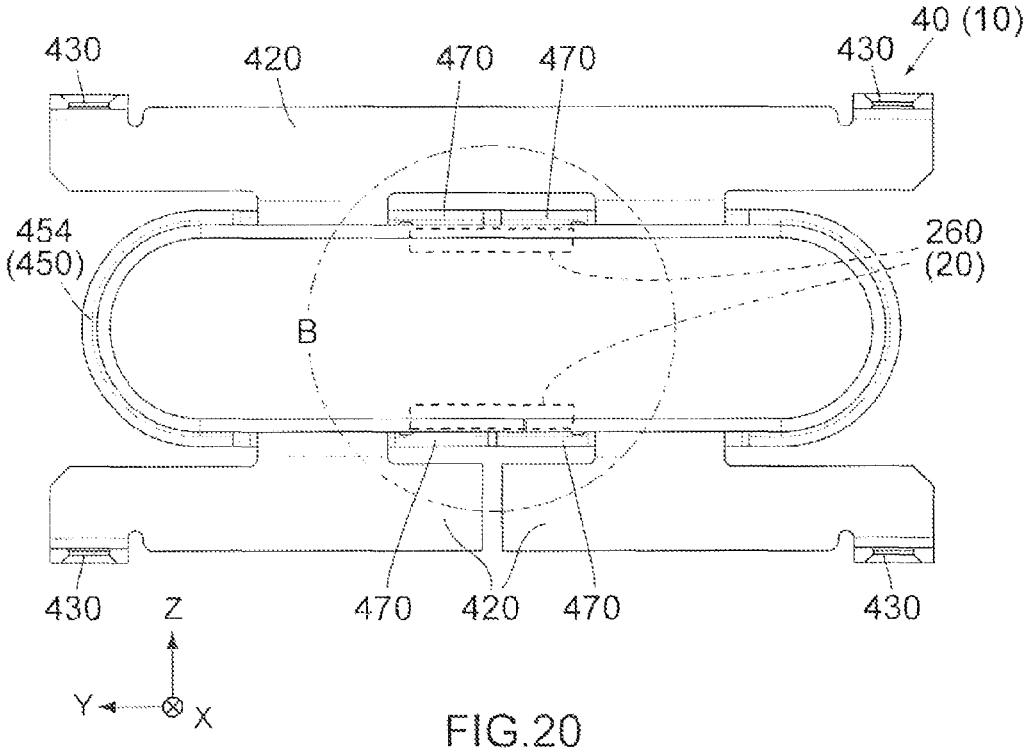
FIG. 20 is a rear view showing the shell of FIG. 17, wherein an outline of each of the receiving portions of the housing, to which the shell is attached, is illustrated by dashed line.

Referring to FIGS. 18 to 20, two of the fixed portions 430 extend rearward from opposite ends of the upper regulated portion 420 in the Y-direction, respectively. Remaining two of the fixed portions 430 extend rearward from outside ends of the two lower regulated portions 420 in the Y-direction, respectively. In other words, each of the fixed portions 430 according to the present embodiment is a projection piece which extends from the corresponding regulated portion 420. However, each of the fixed portions 430 may be provided to a portion other than the regulated portions 420. For example, each of the fixed portions 430 may extend rearward from the rear edge 454 of the cylindrical portion 450.

Referring to FIG. 3, the two additional members 50 have shapes same as each other. In other words, the two additional members 50 are the same components. The two additional members 50 are arranged differently from each other in the connector 10. More specifically, the additional members 50 are positioned to be rotationally symmetrical to each other with respect to an axis in parallel to the X-direction.

Figure 22:
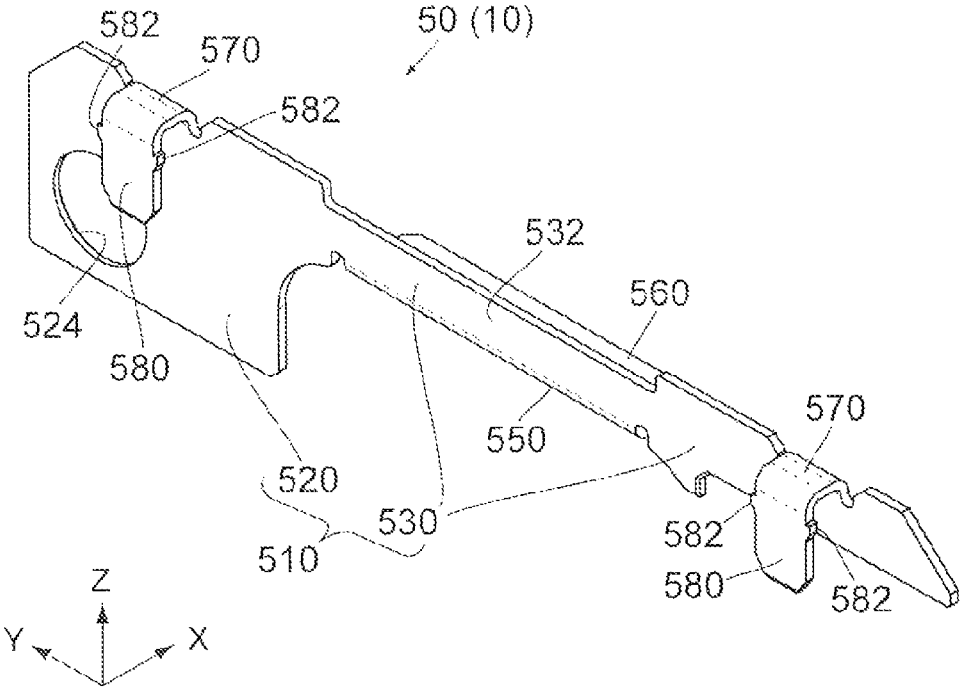
FIG. 22 is a perspective view showing an additional member of the connector of FIG. 3.
Figure 23:
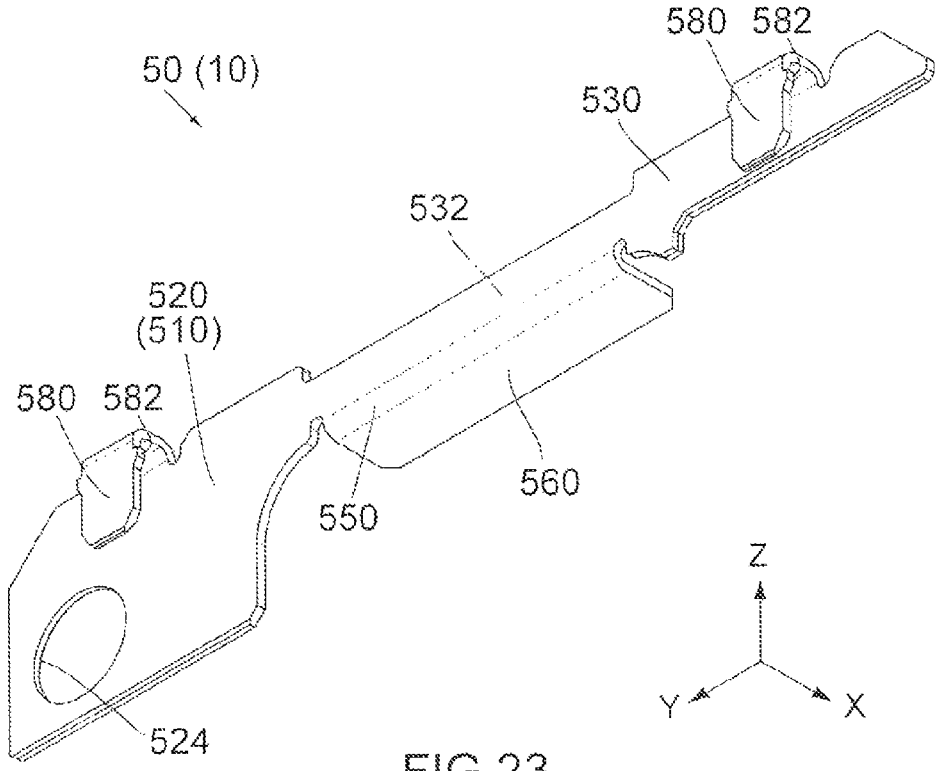
FIG. 23 is another perspective view showing the additional member of FIG. 22.
Figure 24:
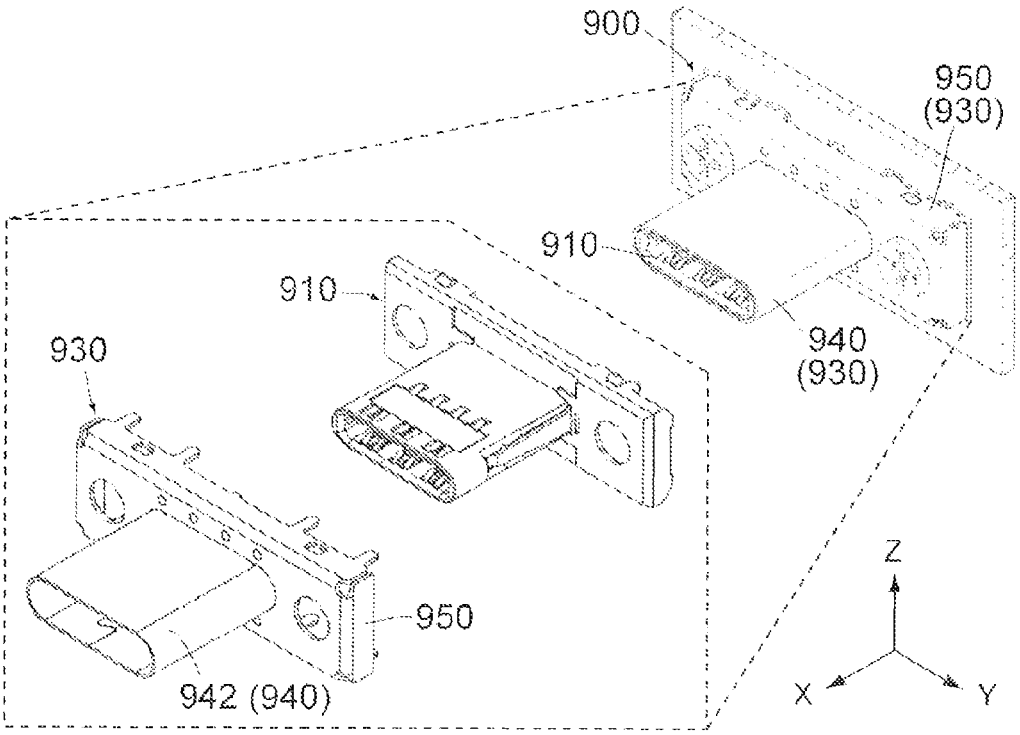
FIG.24 PRIOR ART
FIG. 24 is a perspective view showing a connector of Patent Document 1, wherein an exploded, perspective view in an area enclosed by dashed line shows a housing and a shielding member of the connector.
Figure 25:
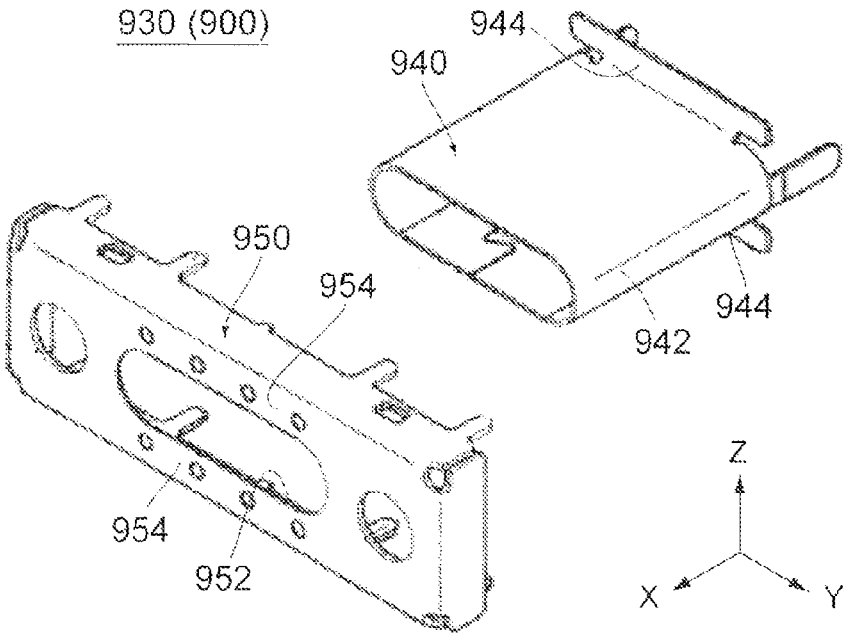
FIG.25 PRIOR ART
FIG. 25 is an exploded, perspective view showing the shielding member of FIG. 24.

As can be seen from FIGS. 1 and 3, when the two additional members 50 are vertically coupled to each other, the two additional members 50 surround the cylindrical portion 450 of the shell 40 in the YZ-plane. As shown in FIGS. 3, 22 and 23, each of the additional members 50 according to the present embodiment has a main portion 510 perpendicular to the X-direction. The main portion 510 has a fastened portion 520 and an extending portion 530. A size of the extending portion 530 in the Z-direction is smaller than another size of the fastened portion 520 in the Z-direction. In the upper additional member 50, the extending portion 530 extends in the negative Y-direction from the negative Y-side end of the fastened portion 520. In the lower additional member 50, the extending portion 530 extends in the positive Y-direction from the positive Y-side end of the fastened portion 520.

Referring to FIGS. 22 and 23, each of the additional members 50 is formed with a second hole 524 and a regulation portion 532. The second hole 524 pierces the additional member 50 in the X-direction. In the present embodiment, the second hole 524 is formed in the fastened portion 520 of the main portion 510, and the regulation portion 532 is a part of the extending portion 530 of the main portion 510. In other words, the main portion 510 has the second hole 524 and the regulation portion 532.

As shown in FIGS. 22 and 23, each of the additional members 50 has a connection portion 560 and two press-fit portions 580 in addition to the main portion 510. Each of the connection portion 560 and the press-fit portions 580 extends from the main portion 510. In detail, the connection portion 560 is a flat plate perpendicular to the Z-direction and is connected to the regulation portion 532 of the extending portion 530 of the main portion 510 through a coupling portion 550 which is bent to have an L-like shape. The thus-formed connection portion 560 extends forward along the X-direction from the coupling portion 550. The press-fit portions 580 are provided in the vicinities of opposite ends of the main portion 510 in the Y-direction. Each of the press-fit portions 580 extends in the perpendicular direction perpendicular to the X-direction. Each of the press-fit portions 580 is a metal piece perpendicular to the X-direction and is connected to the main portion 510 through a coupling portion 570 which is bent to have a U-like shape. Each of the thus-formed press-fit portions 580 extends inward in the Z-direction from the coupling portion 570. Each of the press-fit portions 580 has two press-fit projections 582 which project outward in the Y-direction.

Referring to FIG. 3, each of the insulating members 60 according to the present embodiment is a rectangular insulation sheet. However, each of the insulating members 60 may have any shape and may be made of any material, provided that each of the insulating members 60 has a sufficient insulation property. Moreover, the insulating members 60 may be provided as necessary.

The housing 20, the internal assembly 30, the shell 40, the additional members 50 and the insulating members 60 are assembled as described below to form the connector 10 of the present embodiment.

Figure 7:
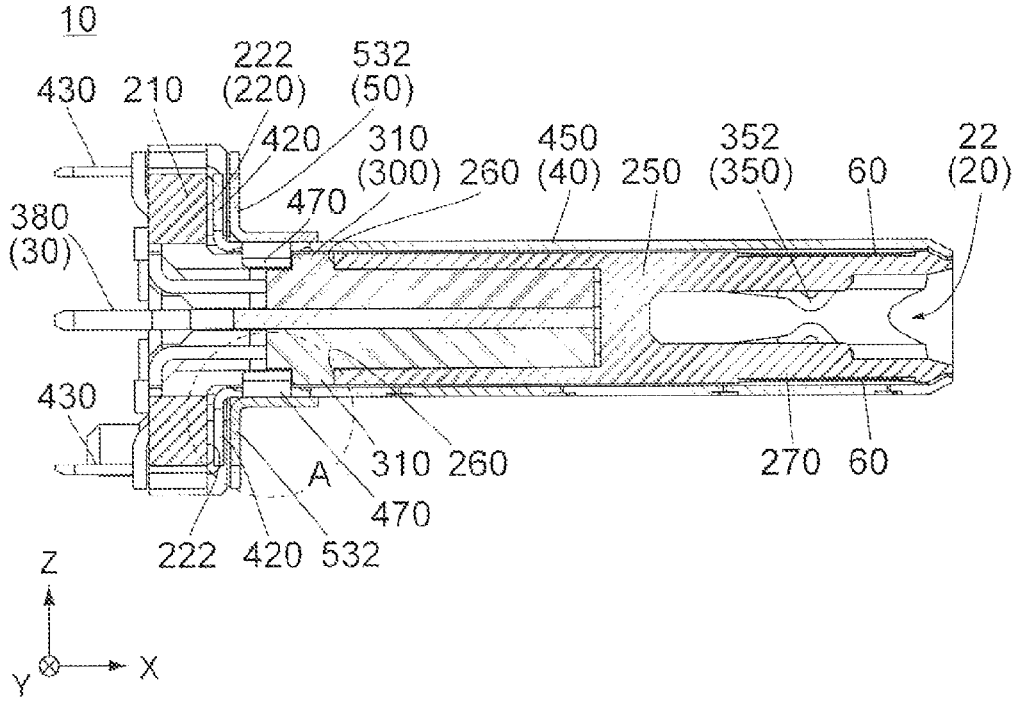
FIG. 7 is a cross-sectional view showing the connector of FIG. 6, taken along line VII-VII.
Figure 9:
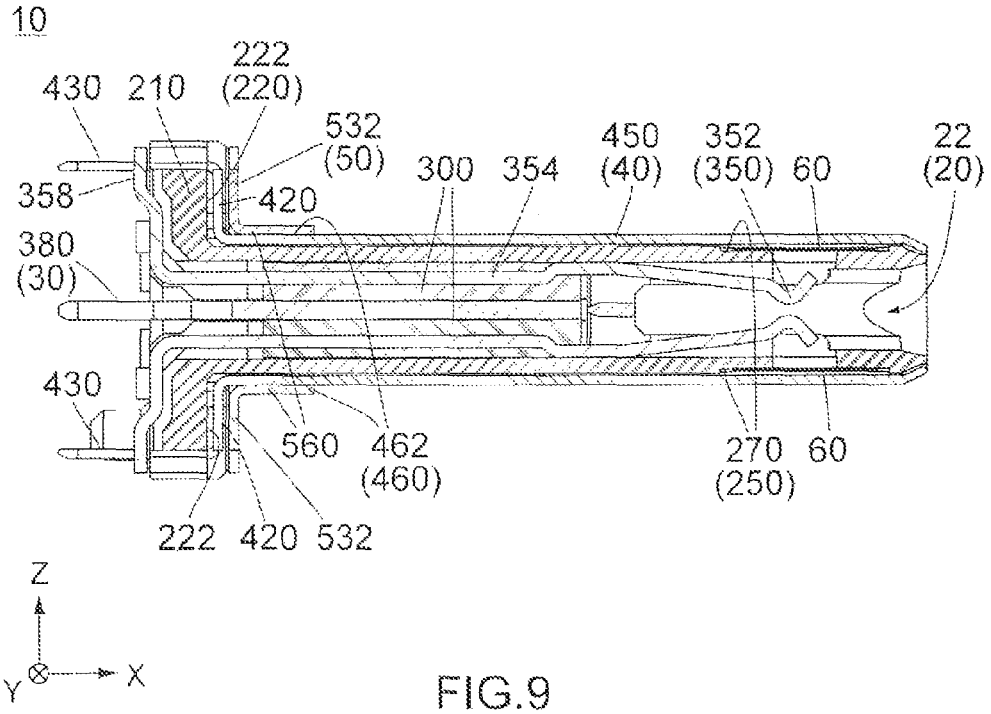
FIG. 9 is a cross-sectional view showing the connector of FIG. 6, taken along line IX-IX.

First, as can be seen from FIGS. 3, 7 and 9, the two insulating members 60 are adhered to the covered portions 270 of the housing 20, respectively. The thus-adhered insulating members 60 of the connector 10 reliably insulate the contact portions 352 of the contacts 350 from the cylindrical portion 450 of the shell 40.

Figure 5:
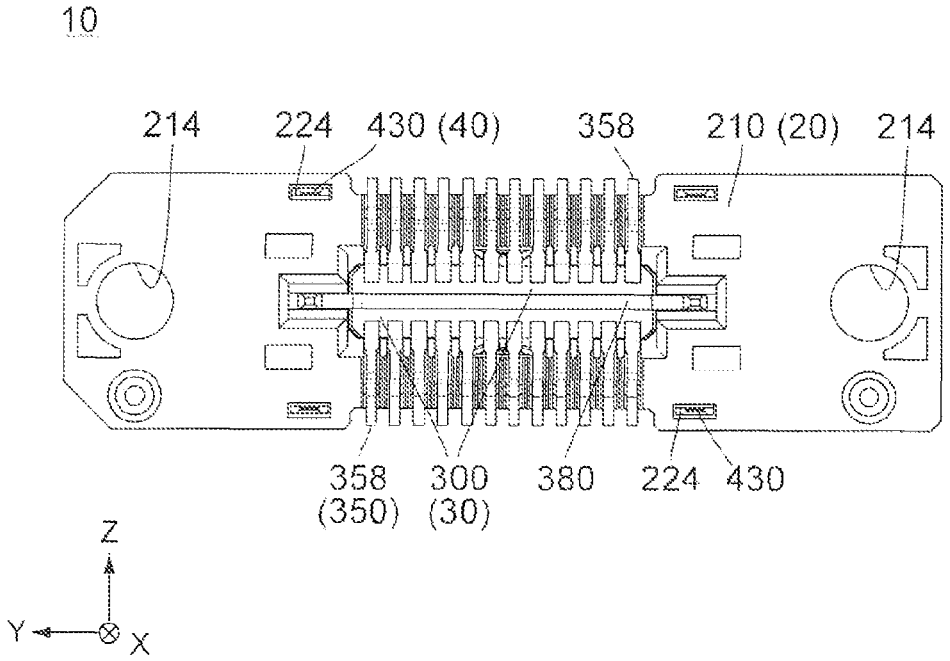
FIG. 5 is a rear view showing the connector of FIG. 1.
Figure 8:
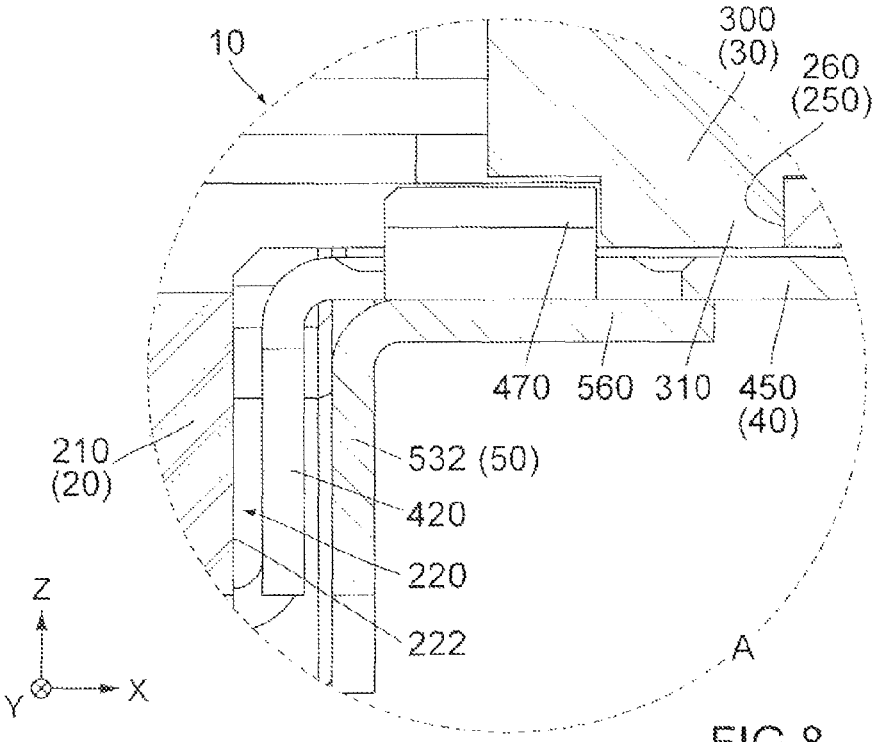
FIG. 8 is a cross-sectional view showing a part of the connector (the part enclosed by dashed line A) of FIG. 7.

Then, as can be seen from FIGS. 2 and 3, the internal assembly 30 is inserted into the accommodation portion 22 of the housing 20 from behind. The thus-inserted internal assembly 30 is partially accommodated in the accommodation portion 22. Referring to FIGS. 5 and 9, the internal assembly 30 is almost entirely accommodated in the accommodation portion 22 except the fixed portions 358 of the contacts 350 and rear end portions, or the negative X-side end portions, of the ground plate 380. When the internal assembly 30 is thus accommodated, the fixed portions 358 are positioned rearward of the base portion 210 and extend outward in the Z-direction. Moreover, the rear end portions of the ground plate 380 extend rearward from the base portion 210. Referring to FIGS. 7 and 8, under this state where the internal assembly 30 is thus accommodated, the received portions 310 of the internal assembly 30 are received in the receiving portions 260 of the housing 20, respectively, and front walls (i.e., the positive X-side walls) of the receiving portions 260 prevent the received portions 310 from being moved forward, respectively.

Then, as can be seen from FIGS. 1 and 3, the shell 40 is attached to the housing 20 from the front. First, the body portion 250 of the housing 20 is inserted into the cylindrical portion 450 of the shell 40. This insertion of the body portion 250 roughly positions the shell 40 relative to the housing 20 in the YZ-plane. Then, referring to FIGS. 3 to 5, the shell 40 is further moved rearward so that the fixed portions 430 of the shell 40 are inserted into the positioning holes 224 of the base portion 210 of the housing 20, respectively. This insertion of the fixed portions 430 accurately positions the shell 40 relative to the housing 20 in the YZ-plane. Then, the shell 40 is further moved rearward. Referring to FIG. 12, the rear edge 454 of the cylindrical portion 450 is finally brought into abutment with the abutment surface 212 of the base portion 210, so that the movement of the shell 40 is stopped. At that time, the shell 40 is attached to the housing 20.

Referring to FIG. 5, as described above, the shell 40 according to the present embodiment is positioned in the YZ-plane by the fixed portions 430 which pass through the positioning holes 224, respectively. The housing 20 has a plurality of the positioning holes 224 which correspond to a plurality of the fixed portions 430, respectively, and therefore, the shell 40 is more accurately positioned in the YZ-plane. However, the shell 40 may have only one fixed portion 430 and the housing 20 may have only one positioning hole 224. Moreover, the housing 20 may have no positioning hole 224. For example, the housing 20 may have a plurality of positioning channels instead of the positioning holes 224, wherein the positioning channels may be formed in an upper surface and a lower surface of the base portion 210, and each of the positioning channels may extend in the X-direction.

Referring to FIG. 12, when the shell 40 is attached to the housing 20, the rear edge 454 of the cylindrical portion 450 is in abutment with the base portion 210 of the housing 20, so that the shell 40 is positioned at a predetermined position relative to the housing 20 in the X-direction. Since the abutment surface 212 of the base portion 210 according to the present embodiment is a flat surface perpendicular to the X-direction, the shell 40 can be more accurately positioned. However, the abutment surface 212 may be an irregular surface, provided that the shell 40 can be positioned with sufficient accuracy. Moreover, the shell 40 may be positioned by some method other than the abutment of the rear edge 454 with the abutment surface 212.

Figure 4:
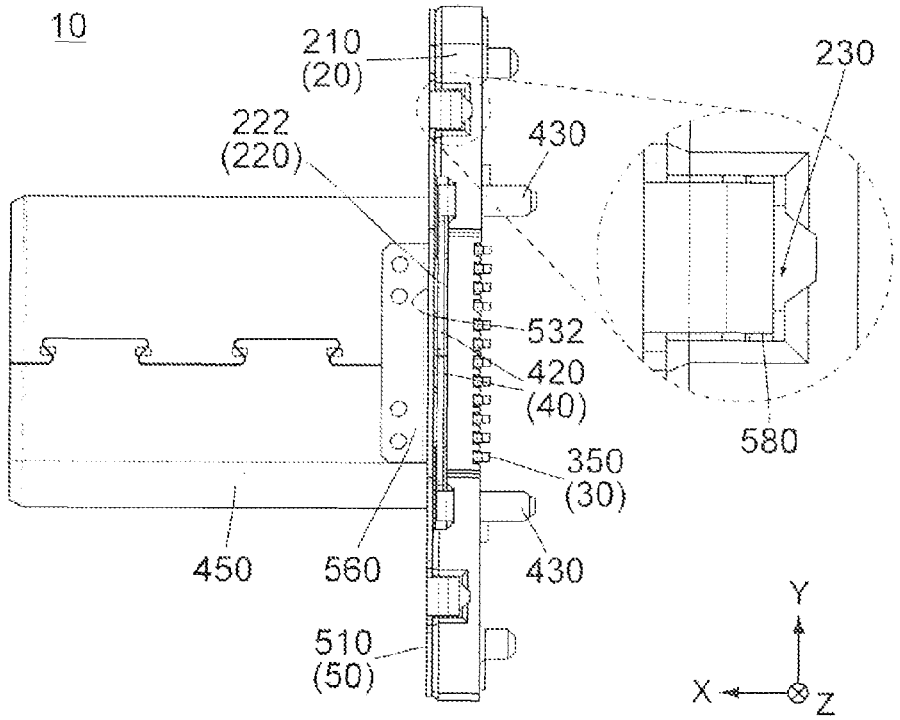
FIG. 4 is a bottom view showing the connector of FIG. 1, wherein a part in the vicinity of a press-fit hole of a housing of the connector (the part enclosed by dashed line) is enlarged to be illustrated.

Referring to FIG. 1, under a shell-attached state where the shell 40 is attached to the housing 20, the cylindrical portion 450 covers the body portion 250 of the housing 20 in the YZ-plane. Referring to FIGS. 3 to 5, under the shell-attached state, the fixed portions 430 pass through the positioning holes 224, respectively, and extend rearward beyond the base portion 210.

Referring to FIGS. 4 and 8, under the shell-attached state, each of the regulated portions 420 of the shell 40 is positioned within the corresponding indented portion 220. In the present embodiment, each of the regulated portions 420 is apart from the regulation surface 222 of the corresponding indented portion 220 to be positioned forward of the corresponding regulation surface 222. However, each of the regulated portions 420 may be in contact with the corresponding regulation surface 222. As described above, the indented portions 220 according to the present embodiment can receive the regulated portions 420 under the shell-attached state, respectively. The thus-provided indented portions 220 allow positional inaccuracy of the regulated portion 420 in the X-direction which might be caused because of manufacturing tolerance, etc. Thus, the rear edge 454 (see FIG. 12) and the abutment surface 212 are necessarily brought into abutment with each other.

Referring to FIGS. 12, 20 and 21, under the shell-attached state, each of the lock portions 470 of the shell 40 is positioned outward of the corresponding receiving portion 260 of the housing 20 in the Z-direction. In detail, the two upper lock portions 470 are positioned just over the upper receiving portion 260, and the two lower lock portions 470 are positioned just under the lower receiving portion 260. Each of the thus-arranged lock portions 470 can be bent toward the inside of the corresponding receiving portion 260.

Then, as can be seen from FIGS. 7 and 21, each of the lock portions 470 is bent and inserted into the corresponding receiving portion 260. This insertion regulates a movement of each of the lock portions 470 in the X-direction. In detail, according to the present embodiment, each of the lock portions 470 received in the corresponding receiving portion 260 is positioned rearward of the corresponding received portion 310 of the internal assembly 30 within the corresponding receiving portion 260. If the shell 40 is forced to be removed forward, each of the lock portions 470 is brought into abutment with the corresponding received portion 310. Therefore, the shell 40 is securely attached to the housing 20. Moreover, if the internal assembly 30 is forced to be removed rearward, each of the received portions 310 is brought into abutment with the corresponding lock portions 470. Therefore, the internal assembly 30 is also securely attached to the housing 20.

However, the lock portions 470 and the receiving portions 260 can be variously modified. For example, the cylindrical portion 450 of the shell 40 may have only one lock portion 470 in each of the upper plate and the lower plate thereof. Moreover, the cylindrical portion 450 may have only one lock portion 470 in only one of the upper plate and the lower plate thereof. Moreover, the body portion 250 of the housing 20 may be formed with to second receiving portions in addition to the receiving portions 260. In this case, each of the lock portions 470 may be received in the corresponding receiving portion 260 while each of the received portions 310 may be received in the corresponding second receiving portion. When the second receiving portions are provided, each of the receiving portions 260 and the second receiving portions may be a depression instead of the hole. According to the aforementioned structure, when the shell 40 is forced to be removed forward, each of the lock portions 470 is brought into abutment with the front wall of the corresponding receiving portion 260. Therefore, the shell 40 is also securely attached to the housing 20.

As can be seen from FIGS. 1 and 3, after the shell 40 is attached to the housing 20, the two additional members 50 are attached to the housing 20 from above and below, respectively. In detail, the two press-fit portions 580 of the upper additional member 50 are press-fit into the two upper press-fit holes 230 of the housing 20, respectively. Similarly, the two press-fit portions 580 of the lower additional member 50 are press-fit into the two lower press-fit holes 230 of the housing 20, respectively. The thus-attached additional members 50 are fixed to the housing 20.

Referring to FIG. 4, when the additional members 50 are fixed to the housing 20, each of the press-fit portions 580 is press-fit in the corresponding press-fit hole 230 of the housing 20. Referring to FIGS. 4, 7 and 8, as a result, the regulation portion 532 of each of the additional members 50 covers the corresponding regulated portion 420 of the shell 40 from the front. Each of the regulated portions 420 is positioned between the corresponding regulation portion 532 and the base portion 210 of the housing 20 in the X-direction, so that a movement of each of the regulated portions 420 in the X-direction is regulated. According to the present embodiment, each of the regulated portions 420 is apart from the corresponding regulation portion 532 to be positioned rearward of the corresponding regulation portion 532. However, each of the regulated portions 420 may be in contact with the corresponding regulation portion 532.

Referring to FIG. 4, when the additional members 50 are fixed to the housing 20, the forward removal of the shell 40 is more securely prevented by the regulation portions 532 arranged as described above. In particular, each of the press-fit portions 580 of the additional members 50 according to the present embodiment extends in the Z-direction and is press-fit in the corresponding press-fit hole 230. Moreover, in each of the additional members 50, the two press-fit portions 580, which are positioned to be apart from each other in the Y-direction, are press-fit in the two press-fit holes 230, respectively. Therefore, the additional members 50 can strongly resist a force in the X-direction.

However, the appropriate number of the press-fit portions 580 may be provided at proper positions as necessary. For example, the number of the press-fit portions 580 in each of the additional members 50 may be one or may be 3 or more. The press-fit holes 230 of the base portion 210 may be provided so as to correspond to the press-fit portions 580 of the additional members 50. For example, in a case where the number of the press-fit portion 580 in each of the two additional members 50 is one, the base portion 210 may be formed with two of the press-fit holes 230 which correspond to the additional members 50, respectively.

Moreover, each of the press-fit holes 230 and the press-fit portions 580 may be oblique to the X-direction to some extent, provided that each of the press-fit portions 580 can be press-fit into the corresponding press-fit hole 230. In other words, each of the press-fit holes 230 may extend in a direction intersecting with the X-direction. Similarly, each of the press-fit portions 580 may extend in another direction intersecting with the X-direction so as to be press-fit in the corresponding press-fit hole 230.

Moreover, since the shell 40 can be fixed to the housing 20 without the additional members 50, the regulated portions 420 and the regulation portions 532 are not always required to be provided. In a case where the regulated portions 420 and the regulation portions 532 are not provided, the indented portions 220 of the base portion 210 of the housing 20 are not required to be provided. Moreover, the shell 40 may have only one of the regulated portions 420, for example, only the upper regulated portion 420, while the shell 40 may have four or more of the regulated portions 420. Moreover, the two lower regulated portions 420 may be coupled to each other to form one regulated portion 420. The additional members 50 can be modified in accordance with these modifications of the shell 40. For example, each of the additional members 50 may have a plurality of the regulation portions 532 which are positioned forward of a plurality of the regulated portions 420, respectively.

Referring to FIGS. 1 and 9, the two connected portions 460 of the shell 40 correspond to the two additional members 50, respectively. When the additional members 50 are fixed to the housing 20, the connection portion 560 of each of the additional members 50 is positioned outward of the corresponding connected portion 460 of the shell 40 in the Z-direction and covers the corresponding connected portion 460. In detail, the connection portion 560 of the upper additional member 50 is positioned just over the upper connected portion 460 to be in contact with the upper connected portion 460 and covers the upper connected portion 460. Similarly, the connection portion 560 of the lower additional member 50 is positioned just under the lower connected portion 460 to be in contact with the lower connected portion 460 and covers the lower connected portion 460. Thus, the body portion 250 of the housing 20 and each of the connection portions 560 sandwich the corresponding connected portion 460 in the Z-direction.

Referring to FIG. 9, since the connected portion 460 and the connection portion 560 corresponding to each other are arranged as describe above, each of the connection portions 560 can be welded to the welded portions 462 of the corresponding connected portion 460, for example, via laser welding, with no use of a maintenance mechanism such as a fixing jig. As explained above, according to the present embodiment, only by fixing the additional members 50 to the housing 20 subsequent to the attachment of the shell 40 to the housing 20, the shell 40 and the additional members 50 can be maintained under a state where each of the additional members 50 can be welded to the shell 40. In other words, the shell 40 and each of the additional members 50 can be welded to each other with no use of a maintenance mechanism such as a fixing jig.

If the connected portion 460 is positioned behind the regulation portion 532 of the additional member 50 so that the regulation portion 532 is welded to the connected portion 460, a laser beam in laser welding is required to be irradiated along the X-direction. However, since the cylindrical portion 450 of the shell 40 extends long along the X-direction, the cylindrical portion 450 might interfere the radiation of the laser beam along the X-direction. Moreover, if the laser beam is irradiated along a direction oblique to the X-direction, the laser beam might be reflected to damage the shell 40 and the additional members 50. In contrast, according to the present embodiment, the laser beam can be irradiated to the connection portion 560 along the Z-direction. Therefore, the shell 40 and each of the additional members 50 can be welded to each other with no damage of the shell 40 and the additional members 50.

Figure 6:
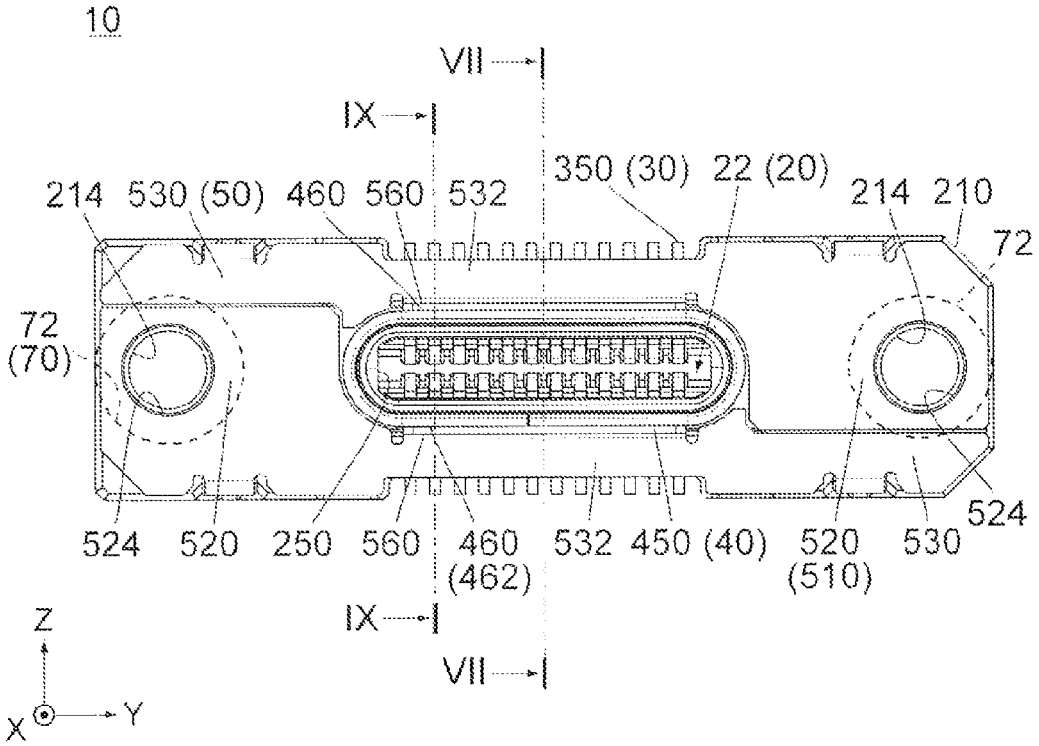
FIG. 6 is a front view showing the connector of FIG. 1, wherein an outline of a head of each of the screws is illustrated by dashed line.

Referring to FIG. 6, when each of the additional members 50 is welded to the shell 40, the connector 10 is completely formed. In the thus-formed connector 10, the shell 40 and each of the additional members 50 are fixed to each other. In detail, the connection portion 560 of each of the additional members 50 is welded and fixed to the corresponding connected portion 460 of the shell 40. In particular, each of the connection portions 560 of flat plate-like shape perpendicular to the Z-direction is fixed to the corresponding connected portion 460 of flat plate-like shape perpendicular to the Z-direction. Moreover, the two connection portions 560, which are positioned at opposite sides across the body portion 250 in the Z-direction, are fixed to the two connected portions 460, respectively.

The aforementioned structure makes the shell 40 hard to be damaged even under a state where the connector 10 receives a flapping force or a twisting force. However, the present invention is not limited thereto. For example, each of the number of the connection portions 560 and the number of the connected portions 460 may be 3 or more, provided that the cylindrical portion 450 of the shell 40 has the connected portions 460 which correspond to the additional members 50, respectively. In other words, the number of the additional members 50 may be 3 or more. Moreover, each of the additional members 50 can be fixed to the shell 40 via various methods instead of the aforementioned welding. For example, the additional members 50 can be fixed to the shell 40 via soldering or screwing.

As can be seen from FIGS. 4, 7 and 12, the shell 40 and the additional members 50 fixed to each other work as one electromagnetic shielding member of the connector 10. In particular, the connection portion 560 of each of the additional members 50 covers the outside of the corresponding receiving portion 260 of the housing 20 in the Z-direction. As a result, the receiving portions 260 are also covered and electromagnetically shielded. However, the present invention is not limited thereto. For example, in a case where there is no need to consider leakage of electromagnetic wave through the receiving portions 260, the connection portions 560 are not required to cover the receiving portions 260. In other words, each of the receiving portions 260 may be opened outward of the connector 10. Moreover, each of the connection portions 560 may be positioned forward of the corresponding receiving portion 260, or forward of the corresponding lock portions 470.

Referring to FIGS. 1 and 6, the two first holes 214 of the base portion 210 of the housing 20 are provided at positions which correspond to those of the second holes 524 of the two additional members 50 in the YZ-plane, respectively. In other words, the base portion 210 is formed with the first holes 214 which correspond to the second holes 524, respectively. Therefore, the connector 10 is attachable to the circuit board 850 via screwing in which the first holes 214 and the second holes 524 are used. In detail, the connector 10 is attachable to the circuit board 850 via the screwing in which two screws 70 pass through hole sets, respectively, wherein each of the hole sets includes one of the first holes 214 and one of the second holes 524 corresponding to each other.

Referring to FIGS. 1 and 6, the second hole 524 of the upper additional member 50 is positioned in the vicinity of the extending portion 530 of the lower additional member 50, and the second hole 524 of the lower additional member 50 is positioned in the vicinity of the extending portion 530 of the upper additional member 50. According to this arrangement, when the connector 10 is attached to the circuit board 850 via the screwing of the screws 70, a head 72 of each of the screws 70 fastens the two adjacent additional members 50 against the base portion 210. In detail, the head 72 of the positive Y-side screw 70 fastens the fastened portion 520 (the main portion 510) of one of the additional members 50, or the upper additional member 50, against the base portion 210 together with the extending portion 530 (the main portion 510) of a remaining one of the additional members 50, or the lower additional member 50. Similarly, the head 72 of the negative Y-side screw 70 fastens the fastened portion 520 of the remaining one of the additional members 50, or the lower additional member 50, against the base portion 210 together with the extending portion 530 of the one of the additional members 50, or the upper additional member 50. The thus-fastened two additional members 50 can be fixed to each other. When each of the heads 72 is provided with a metal washer (not shown), the heads 72 and the metal washers can more securely fix the two additional members 50 to each other.

Referring to FIG. 2, when the connector 10 is mounted on the circuit board 850 (see FIG. 1), the fixed portions 430 of the shell 40 are fixed to the circuit board 850 via soldering, etc. and connected to ground patterns (not shown) of the circuit board 850. Similarly, the rear end portions of the ground plate 380 are fixed to the circuit board 850 via soldering, etc. and connected to ground patterns of the circuit board 850. In addition, the fixed portions 358 of the contacts 350 are fixed to the circuit board 850 via soldering, etc. and connected to signal patterns (not shown) of the circuit board 850. The aforementioned soldering securely fixes and electrically connects the connector 10, in particular, the shell 40, to the circuit board 850.

The connector 10 according to the present embodiment can be modified variously in addition to the already explained modifications.

Referring to FIG. 3, the connector 10 may comprise the other members in addition to the housing 20, the internal assembly 30, the shell 40, the additional members 50 and the insulating members 60. The two additional members 50 may have shapes different from each other. The internal assembly 30 may have a structure different from that of the present embodiment, provided that the internal assembly 30 includes the holding member 300 and the contact 350.

The housing 20 may have no receiving portion 260, and the shell 40 may have no lock portion 470. In this case, each of the housing 20 and the shell 40 has a more simple structure. In addition, the bending process of the lock portions 470 is not required. In the case where the housing 20 has no receiving portion 260, the internal assembly 30 may have no received portion 310.

Referring to FIG. 1, the connector 10 may be a connector which is used without being mounted on the circuit board 850. In this case, the first holes 214 and the second holes 524 are not required to be provided. However, the first holes 214 and the second holes 524 may be provided only to fix the two additional members 50 to each other.

Referring to FIG. 3, each of the fixed portions 430 of the shell 40 may be provided with press-fit projections similar to the press-fit projections 582 (see FIG. 22) of the press-fit portion 580 of the additional member 50. The press-fit projections of the fixed portion 430 may be provided so as to project outward in the Y-direction from opposite sides of the fixed portion 430 in the Y-direction. When the fixed portions 430, each of which has the aforementioned press-fit projections, are press-fit in the positioning hole 224 of the housing 20, the shell 40 can be more securely fixed to the housing 20.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with an object along a front-rear direction, the connector comprising a housing, an internal assembly, a shell and two additional members, wherein:

the housing has a base portion and a body portion;

the body portion extends forward from the base portion along the front-rear direction;

the base portion is formed with two press-fit holes which correspond to the additional members, respectively;

each of the press-fit holes extends in a direction intersecting with the front-rear direction;

the body portion is formed with an accommodation portion;

the internal assembly comprises a holding member and a contact and is partially accommodated in the accommodation portion;

the shell has a cylindrical portion;

the cylindrical portion covers the body portion of the housing in a plane perpendicular to the front-rear direction and has two connected portions which correspond to the additional members, respectively;

each of the additional members has a main portion, a press-fit portion and a connection portion;

the press-fit portion of each of the additional members is connected to the main portion, extends in a direction intersecting with the front-rear direction and is press-fit in the corresponding press-fit hole of the housing;

the connection portion of each of the additional members extends from the main portion along the front-rear direction and is welded to the corresponding connected portion of the shell;

the body portion of the housing and each of the connection portions sandwich the corresponding connected portion in a perpendicular direction perpendicular to the front-rear direction;

the body portion of the housing is formed with a receiving portion;

the cylindrical portion of the shell has a lock portion;

the lock portion is received in the receiving portion; and the lock portion is received in the receiving portion.

2. The connector as recited in claim 1, wherein:

the holding member of the internal assembly has a received portion; and the received portion is received in the receiving portion.

3. The connector as recited in claim 2, wherein the lock portion of the shell is positioned rearward of the received portion within the receiving portion.

4. The connector as recited in claim 1, wherein the cylindrical portion of the shell has a rear edge which is in abutment with the base portion.

5. The connector as recited in claim 1, wherein the connector is mounted on a circuit board when used.

6. The connector as recited in claim 5, wherein:

the base portion of the housing is formed with two first holes;

each of the first holes pierces the base portion in the front-rear direction;

each of the additional members is formed with a second hole;

the second holes pierce the additional members in the front-rear direction, respectively;

the first holes correspond to the second holes, respectively; and the connector is attachable to the circuit board via screwing in which the first holes and the second holes are used.

7. The connector as recited in claim 6, wherein:

the second holes are formed in the main portions of the additional members, respectively;

the connector is attachable to the circuit board via the screwing in which two screws pass through hole sets, respectively, wherein each of the hole sets includes one of the first holes and one of the second holes corresponding to each other; and when the connector is attached to the circuit board via the screwing of the screws, head of each of the screws fastens the main portion of one of the additional members against the base portion together with the main portion of a remaining one of the additional members.

8. The connector as recited in claim 5, wherein:

the base portion of the housing is formed with a positioning hole;

the positioning hole pierces the base portion in the front-rear direction;

the shell has a fixed portion;

the fixed portion passes through the positioning hole; and the fixed portion is fixed to the circuit board when the connector is mounted on the circuit board.

9. A connector mateable with an object along a front-rear direction, the connector comprising a housing, an internal assembly, a shell and two additional members, wherein:

the housing has a base portion and a body portion;

the body portion extends forward from the base portion along the front-rear direction;

the base portion is formed with two press-fit holes which correspond to the additional members, respectively;

each of the press-fit holes extends in a direction intersecting with the front-rear direction;

the body portion is formed with an accommodation portion;

the internal assembly comprises a holding member and a contact and is partially accommodated in the accommodation portion;

the shell has a cylindrical portion;

the cylindrical portion covers the body portion of the housing in a plane perpendicular to the front-rear direction and has two connected portions which correspond to the additional members, respectively;

each of the additional members has a main portion, a press-fit portion and a connection portion;

the press-fit portion of each of the additional members is connected to the main portion, extends in a direction intersecting with the front-rear direction and is press-fit in the corresponding press-fit hole of the housing;

the connection portion of each of the additional members extends from the main portion along the front-rear direction and is welded to the corresponding connected portion of the shell;

the body portion of the housing and each of the connection portions sandwich the corresponding connected portion in a perpendicular direction perpendicular to the front-rear direction;

the body portion of the housing is formed with a receiving portion;

the cylindrical portion of the shell has a lock portion;

the lock portion is received in the receiving portion;

one of the connected portions of the shell has two welded portions;

the lock portion is positioned between the welded portions in the perpendicular direction; and the connection portion of one of the additional members covers the receiving portion.

10. A connector mateable with an object along a front-rear direction, the connector comprising a housing, an internal assembly, a shell and two additional members, wherein:

the housing has a base portion and a body portion;

the body portion extends forward from the base portion along the front-rear direction;

the base portion is formed with two press-fit holes which correspond to the additional members, respectively;

each of the press-fit holes extends in a direction intersecting with the front-rear direction;

the body portion is formed with an accommodation portion;

the internal assembly comprises a holding member and a contact and is partially accommodated in the accommodation portion;

the shell has a cylindrical portion;

the cylindrical portion covers the body portion of the housing in a plane perpendicular to the front-rear direction and has two connected portions which correspond to the additional members, respectively;

each of the additional members has a main portion, a press-fit portion and a connection portion;

the press-fit portion of each of the additional members is connected to the main portion, extends in a direction intersecting with the front-rear direction and is press-fit in the corresponding press-fit hole of the housing;

the connection portion of each of the additional members extends from the main portion along the front-rear direction and is welded to the corresponding connected portion of the shell;

the body portion of the housing and each of the connection portions sandwich the corresponding connected portion in a perpendicular direction perpendicular to the front-rear direction;

the shell has a regulated portion;

the regulated portion is connected to the cylindrical portion and extends in a direction intersecting with the front-rear direction;

the main portion of one of the additional members has a regulation portion; and the regulated portion is positioned between the regulation portion and the base portion of the housing in the front-rear direction.

11. The connector as recited in claim 10, wherein:
the base portion is formed with an indented portion;
the indented portion is indented rearward; and
the regulated portion is positioned within the indented portion.

* * * * *